US006102750A

United States Patent [19]

Little et al.

[11] Patent Number: 6,102,750

[45] Date of Patent: Aug. 15, 2000

[54] SELF-RETAINING SPRING CLIP ASSEMBLY AND AN ELECTRICAL CONNECTION INCORPORATING THE SAME

[75] Inventors: David E. Little, Beaver Falls; David C. Funyak, Irwin; Roger W. Helms, Beaver Falls, all of Pa.

[73] Assignee: Eaton Corporation, Cleveland, Ohio

[21] Appl. No.: 09/222,150

[22] Filed: Dec. 29, 1998

[51] Int. Cl.[7] ..... H01R 4/36

[52] U.S. Cl. ..... 439/813; 439/812

[58] Field of Search ..... 439/812, 813, 439/801, 810, 811, 814; 200/51 R, 284, 293

[56] References Cited

U.S. PATENT DOCUMENTS

| | | | |
|---|---|---|---|
| 2,205,322 | 6/1940 | Thomas, Jr. et al. . | |
| 2,585,728 | 2/1952 | Bedford, Jr. . | |
| 2,633,886 | 4/1953 | Tinnerman . | |
| 3,559,156 | 1/1971 | Coley . | |
| 3,891,298 | 6/1975 | Yorgin et al. . | |
| 4,059,335 | 11/1977 | Simon . | |
| 4,349,023 | 9/1982 | Gross | 128/214.4 |
| 4,550,970 | 11/1985 | Ogino | 339/97 P |
| 4,629,281 | 12/1986 | Kruger . | |
| 4,949,059 | 8/1990 | Richter, Sr. | 335/202 |
| 4,961,553 | 10/1990 | Todd . | |
| 5,005,104 | 4/1991 | Grunert et al. . | |
| 5,107,396 | 4/1992 | Rosen et al. . | |
| 5,119,054 | 6/1992 | Grunert et al. . | |
| 5,189,596 | 2/1993 | Runge . | |
| 5,206,789 | 4/1993 | Barbry . | |
| 5,493,085 | 2/1996 | Kolberg et al. | 200/51 R |
| 5,761,838 | 6/1998 | Chisholm et al. | 40/716 |

*Primary Examiner*—Neil Abrams
*Assistant Examiner*—Chandrika Prasad
*Attorney, Agent, or Firm*—Martin J. Moran

[57] ABSTRACT

A terminal connection for a flat stab of an electrical terminal includes a spring clip which retains a nut in alignment with an aperture in the flat stab. The spring clip is fabricated from a strip of resilient electrically conductive material and has a top wall with a central aperture, side walls extending downward from the top wall and having slots therein, and outwardly projecting flanges on the bottom edge of each of the side walls. A square nut is retained in the spring clip by lateral projections on the nut engaged in the slots in the side walls with the tapped hole in the nut aligned with the aperture in the top wall of the clip. The fastener assembly clips onto the end of the flat stab which is in a recess in the electrical terminal, with the stab between the nut and the top wall of the spring clip. The outer edges of the flanges on the spring clip frictionally engage against the opposite sides of the recess in the terminal to retain the spring clip and nut in the terminal until a screw is passed through the apertures in the top wall and the flat stab engages the nut to secure a conductor to the stab. The slots in the side walls of the clip prevent rotation of the nut and provide positive stops which resist loss of the nut through application of excessive axial force to the screw.

17 Claims, 3 Drawing Sheets

SELF-RETAINING SPRING CLIP ASSEMBLY AND AN ELECTRICAL CONNECTION INCORPORATING THE SAME

BACKGROUND OF THE INVENTION

1. Field of the Invention

This invention relates to electrical terminations and particularly to such terminations which include an assembly for securing a nut in alignment with an aperture in a flat stab of an electrical switch for receipt of a screw which threads into the nut to fasten an electrical conductor to the flat stab.

2. Background of Information

Electrical switches, including circuit breakers, contactors, motor controllers, motor starters and switches without overload protection, often have flat stabs for connecting the switch to conductors of the electrical system in which the switch is used. Many types of terminal connections are used with such switches, but in a widely used simple connection a spade or eye termination on the electrical conductor is clamped to the stab by a screw passed through an aperture in the stab and secured by a nut. Flat conductors can be secured to the stab in a similar manner with the screw passing through an aperture in the flat conductor as well.

Typically, the stabs are protected within recesses in the switch housing which makes access difficult. For ease in making such connections, it is known to secure the nut to the stab in alignment with the aperture so that only the screw needs to be manipulated. In one such connection, the nut has an annular flange around the tapped hole which is press fit into the aperture in the stab to retain the nut. Thus, special nuts must be provided for each size aperture in the stabs. Also, the nut can be dislodged and dropped by excess pressure applied to the screw before the threads are fully engaged.

In another arrangement, a flat piece of copper and a steel nut are held in spaced relation with an aperture in the piece of copper aligned with the tapped hole in the nut by a flexible bridge along one edge to form a keeper which clips onto the stab. Maintaining alignment is difficult, and again, excess pressure on the screwdriver can displace the steel nut.

In yet another keeper arrangement, a thin piece of copper is bent to form a u-shaped clip with a top wall, an end wall and a bottom wall. A square nut with ears on opposite sides is retained within the u-shaped clip with its tapped hole aligned with holes in the top and bottom walls, and is at the same time prevented from turning, by tabs on the side edges near the free end of the bottom wall. Additional tabs bent down from the sides of the top wall engage the ears on the nut to space it from the top wall to make room for applying the clip to the stab with the stab between the nut and the top wall. The resilient sheet material used for the clip clamps the nut against the stab. One difficulty with this u-shaped spring clip is that excessive axial force on the screw driver bends the bottom wall downward so that the nut can not be engaged by the screw.

Another arrangement is disclosed in U.S. Pat. No. 5,493,085 in which a single piece of spring material is formed into a spring clip having a top wall with a central aperture in it, a pair of slotted side walls, an end wall and a bottom wall cantilevered from the bottom edge of the end wall. A flat nut fits in the pocket formed by the walls of the clip. The nut has projections on opposite sides for fitting in the slots in the side wall. The clip is adapted to slide onto the free end of a flat stab which is received in the pocket between the top wall of the clip and the nut, so the nut can be clamped against the stab.

There is a need for an improved spring clip for electrical connections for electrical terminals having flat stabs, which is easier and more economical to manufacture. There is a further need for such electrical connections which are easy to assembly with an electrical terminal and provide secure retention of a terminal nut in alignment with an aperture in the stab during engagement of the nut by the screw.

There is an additional need for an improved connection which is economical and is easily installed without the need for any special tools.

SUMMARY OF THE INVENTION

These needs and others are satisfied by the invention which is directed to a fastener assembly for securing an electrical conductor to a flat stab and to the combination of such a fastener assembly with an electrical switch having such a flat stab and an electrical conductor for connection to the stab. The fastener assembly includes a clip comprising a top wall having a central aperture, a pair of side edges, a pair of side walls, having slots therein, extending downward from the side edges of the top wall, and a pair of outwardly extending flanges on the bottom edges of the side walls. A flat nut with lateral projections is retained in the clip, with a tapped center hole in the nut in registration with the central aperture in the top wall, by engagement of the lateral projections in the slots in the side walls. The fastener assembly clamps onto the flat stab with the stab received in the pocket between the nut and the top wall. The clip is made preferably from a single piece of electrically conductive resilient material so that the nut is clamped in position against the stab.

To help align the fastener assembly with the aperture in the stab, and to assure retention of the fastener in that position, an axial projection around the aperture in the top wall, preferably in the form of an annular flange, engages the aperture in the stab.

Preferably, the nut is rectangular with ears projecting laterally outward from opposite sides to engage the slots in the side walls of the clip. These slots not only prevent rotation of the nut, but also provide firm support for the nut so that it can not be displaced by excess axial force applied to the screw.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
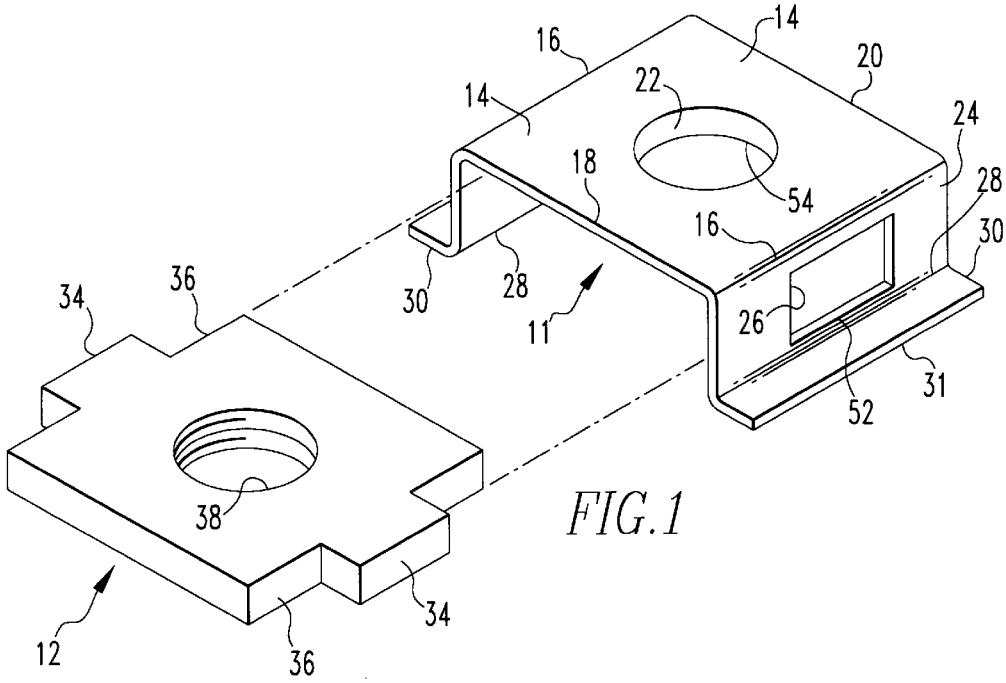
FIG. 1 is an enlarged, exploded isometric view of a preferred embodiment of a spring clip and nut for a fastener assembly of the invention.
Figure 2:
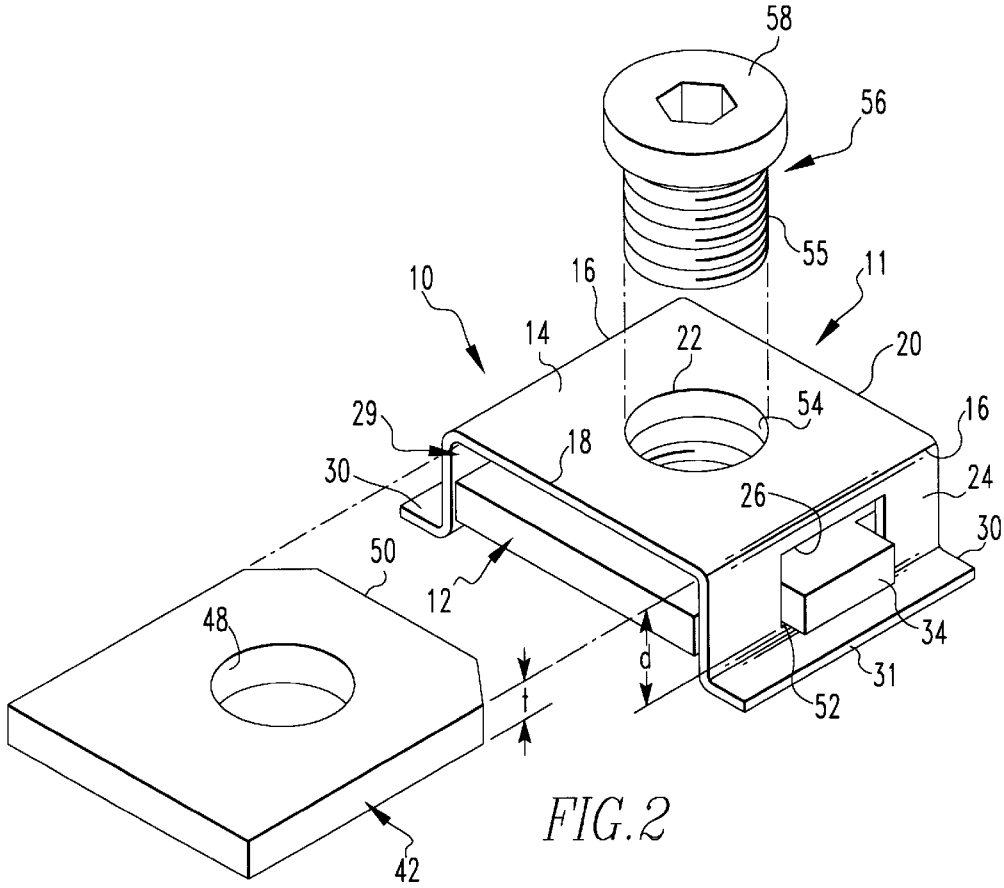
FIG. 2 is an enlarged, isometric view of the fastener assembly of FIG. 1 shown in relation to a circuit breaker stab on which it can be mounted.

The invention will be described as applied to electrical connections for stabs on electrical switches such as circuit breakers, contactors, transfer switches, motor controllers, motor starters, as well as, switches without protection functions. As shown in FIG. 1, such connections have a fastener assembly 10 which includes a spring clip 11 and a nut 12. The spring clip 11 is fabricated from a single piece of electrically conductive resilient material such as a thin copper sheet. This sheet of material is formed into a top wall 14 having a pair of side edges 16, a front edge 18 and a rear edge 20 and a central aperture 22. A pair of side walls 24 extend downward from the side edges 16. The side walls each have a closed slot 26 and a bottom edge 28. A flange 30 projects outward from the bottom edge 28 of each side wall 24. As the strip material is resilient, the side walls 24 can be resiliently deflected relative to the top wall 14. The top wall 14 and side walls 24 cooperate to form a yoke in which the nut 12 is retained.

The nut 12 has a pair of lateral projections or ears 34. Preferably the nut is rectangular, and most preferably square, with projections 34 forming ears on opposed sides 36 of the nut 12. The nut 12 is retained within the spring clip 11 by engagement of the ears 34 in the slots 26. With the nut 12 so retained in the spring clip 11, the tapped hole 38 in the nut 12 is coaxially aligned with the aperture 22 in the top wall 14 of the clip 11.

Figure 3:
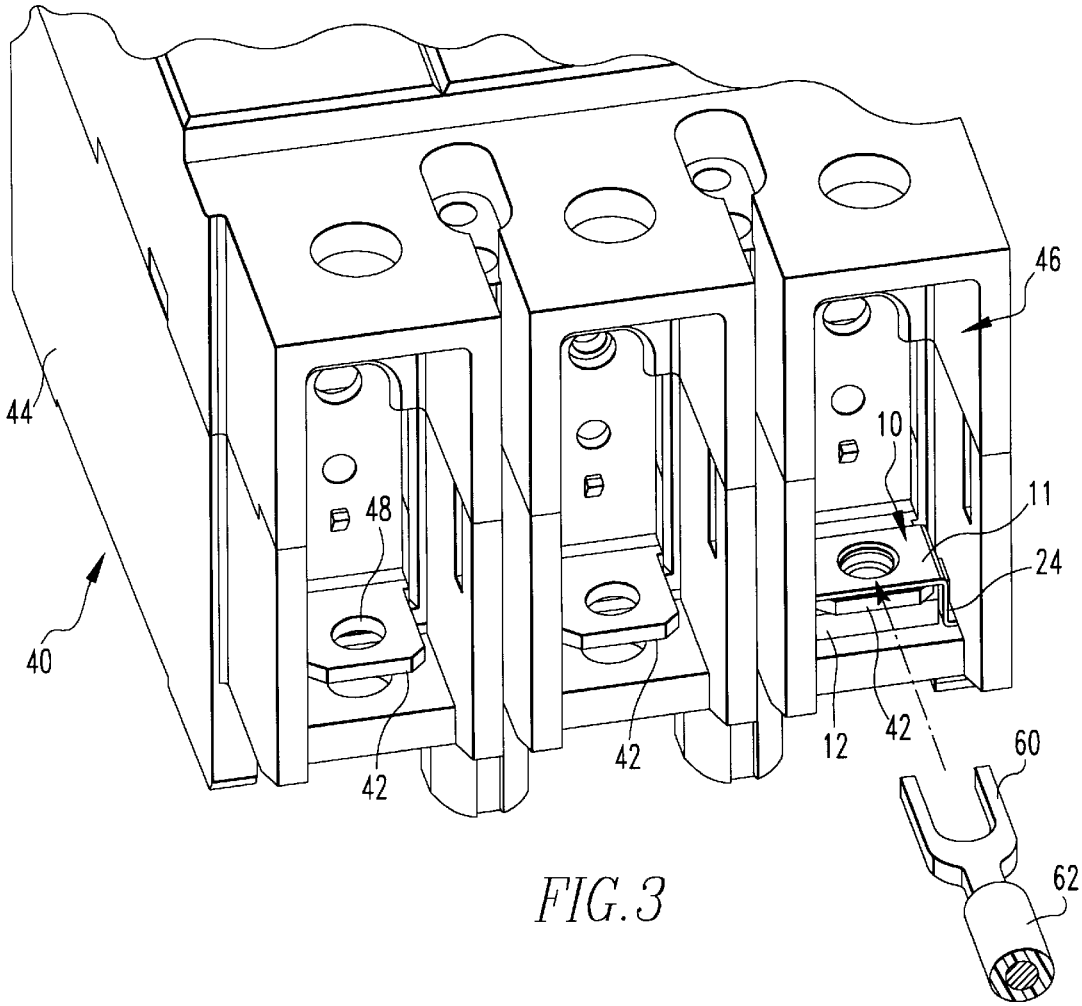
FIG. 3 is a fragmentary isometric view of a portion of an electrical circuit breaker for receiving the fastener assembly of FIGS. 1 and 2, and showing a fastener assembly on one of the stabs in he breaker and a spade terminal preparatory to connection to the breaker.

The fastener assembly 10 is used in connection with a flat stab such as the stabs 42 which forms terminals on the circuit breaker 40 shown in FIG. 3. The circuit breaker 40 may have a molded case or housing 44 such as is shown in FIG. 3, and one or more flat stabs 42 are preferably located in recesses 46 in the molded housing 44 of the circuit breaker 40. Each flat stab 42 has an aperture 48 spaced from its free edge 50. FIG. 3 shows a fastener assembly 10 on the stab 42 on the right hand side of the breaker 40 and a spade connector 60 ready to be connected to the stab.

The fastener assembly 10 is snapped onto the free end 50 of the stab 42 with the stab between the nut 12 and the top wall 14 of the clip 11. The fastener assembly 10 is dimensioned to provide a gap 29 between the top wall 14 and nut 12 to accommodate different thicknesses t of the flat stab 42 with the maximum thickness limited by the distance d between the bottom edges 52 of the slots 26 and the top wall 14 as reduced by the thickness of the nut 12.

The fastener assembly 10 retains the nut 12 on the stab 42 with the tapped hole 38, as well as the aperture 22, in alignment with the aperture 48 in the stab 42. Preferably, the aperture 22 in the top wall 14 is provided with downwardly extending axial projection in the form of an annular flange or burr 54 (FIG. 4) which engages the aperture 48 in the stab 42 to resist the removal of the fastener assembly 10 from the stab 42. The flange 54 need not be an exact fit in the aperture 48 as its purpose is only to prevent sliding of the fastener assembly laterally and not to secure the nut 12 to the stab 42.

It is a feature of this invention that the fastener assembly 10 is self-retaining in an electrical terminal such as the circuit breaker 40. The outer edges 31 of the flanges 30 on opposite sides of the clip 11 frictionally engage the inwardly facing surfaces 47 in the recess 46 of the circuit breaker 40. The spring-like nature of clip 11 permits squeezing of the side walls 24 with respect to the top wall 14 to easily insert the clip assembly into the recess 46. After the assembly 10 has been inserted on the stab 42, the spring action of the clip presses the edges 31 of the flanges 30 against the surfaces 47 in the recess. FIG. 3 shows a fastener assembly 10 of this invention retained in the recess 46 on the right hand side of the circuit breaker 40. See also FIG. 4, which shows a clip assembly 10 secured on a stab 12 with a screw 56. The clip assembly 10 is retained on the stab 42 by both the flange 54 and the friction of the edges 31 of the clip 11 against the surfaces 47 in the recess 46.

Figure 4:
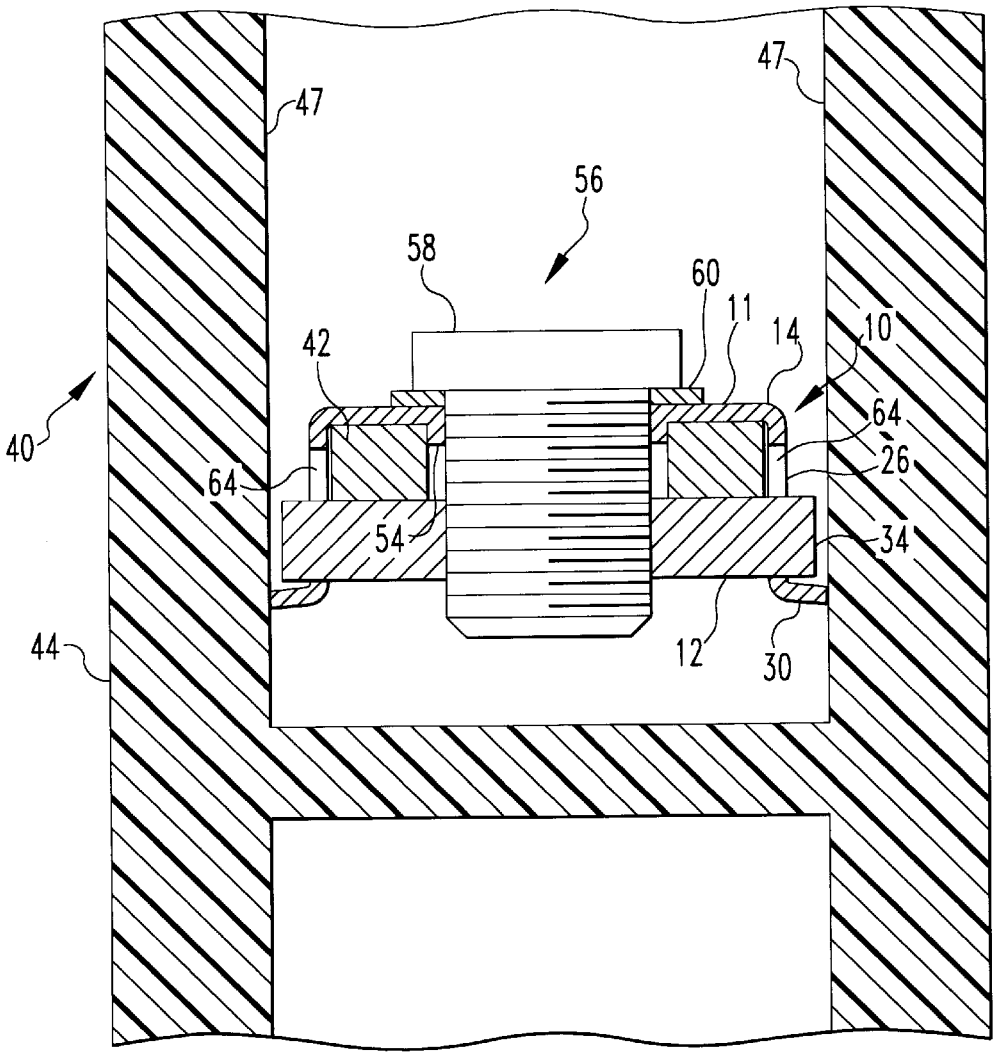
FIG. 4 is a fragmentary vertical section through a portion of the circuit breaker illustrated in FIG. 3 with the fastener assembly of FIGS. 1 and 2 secured to a stab on the circuit breaker.

As is seen in FIG. 4, a screw 56 is passed through the aperture in the top wall 14 of the clip 11 and through the aperture in the stab 42 to engage the tapped bore in the nut 12 retained in place by the clip 11. The screw 56 has a head 58 which engages a termination such as the spade terminal 60 (FIG. 3) secured to the end of the conductor 62 to mechanically and electrically connect the conductor 62 to the stab 42. Other types of termination can be used in place of the spade terminal 60, and in fact, the conductor 62 could be a flat conductor with an aperture, through which the screw 56 passes. The ears 34 of the nut 12 are engaged by the slots 26 in the side walls 24. Thus, upward axial force applied by the screw 56 to the nut 12, when the screw is tightened, is resisted by the top wall 14 and the flat stab 42 disposed between the nut and the top wall. The side edges 64 of the slots 26 prevent rotation of the nut 12 and maintain the nut in a plane perpendicular to the screw 56 so that positive engagement of the nut can be made by the screw.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A fastener assembly for securing an electrical conductor to a flat stab in a recess in an electrical terminal housing having side wall surfaces spaced from the stab, which has an aperture spaced from its free end, said assembly comprising:

a resilient spring clip comprising a top wall having a central aperture, a pair of side edges, a front edge and a rear edge; a pair of side walls extending downward from said pair of side edges of said top wall, each side wall of said pair having a slot therein and a bottom edge with a flange thereon projecting outwardly from said side wall to an outer edge on each flange; a flat nut with a tapped center hole and lateral projections retained in said clip with said tapped center hole in registration with said central aperture in said top wall by engagement of said projections in said slots in said side walls; said clip sliding onto said free end of said stab, which is received between said top wall and said nut with said outer edges on said flanges frictionally engaging said side wall surfaces of said terminal housing, and with said tapped hole in said nut in registration with said aperture in said stab as well as said aperture in said top wall.

2. The assembly of claim 1 wherein said clip is made from a single piece of electrically conductive spring material, said side walls being bent downward from said top wall along said side edges, and said flanges being bent outward from said side walls along said bottom edges.

3. The assembly of claim 1 wherein said central aperture in said top wall has a downwardly extending axial projection engaging said aperture in said stab to retain said clip on said stab.

4. The assembly of claim 3 wherein said axial projection is an axially extending flange.

5. The assembly of claim 4 wherein said nut is generally rectangular with opposed sides and said lateral projections comprise ears extending laterally outward from said opposed sides.

6. The assembly of claim 5 wherein said clip is made from a single piece of electrically conductive spring material, said side walls being bent downward from said top wall along said side edges, and flanges being bent outward from said side walls along said bottom edges.

7. The assembly of claim 1 wherein said nut is generally rectangular with opposed sides and said lateral projections comprise ears extending laterally outward from said opposed sides.

8. The assembly of claim 7 wherein said ears project through said slots.

9. The assembly of claim 8 wherein said flanges project outwardly beyond the outward extent of said ears.

10. The assembly of claim 1 wherein said slots in said side walls have a bottom edge spaced from said top wall by a distance d selected to accommodate flat stabs of a range of thicknesses t.

11. In combination;

an electrical terminal with a flat terminal stab in a recess in the terminal having side wall surfaces spaced from said stab, which has an aperture adjacent a free end;

an electrical conductor having a terminal end for connection to said flat terminal stab;

a terminal screw and a flat nut having a tapped center hole into which said screw is threaded for fastening said terminal end of said electrical conductor to said terminal stab; and an electrically conductive spring clip comprising a top wall, having a pair of side edges and front and rear edges and a central aperture, a side wall extending downward from each of said pair of side edges, each said side wall having a slot in it and a bottom edge with a flange projecting outwardly from said bottom edge, each said flange having an outer terminal edge; and said flat nut having its tapped center hole in registration with said central aperture in said clip and having lateral projections which engage said slots to retain said nut in said spring clip, said spring clip sliding onto said free end of said stab with said stab between said top wall and said nut, and said outer edges of said flanges frictionally engaging said side walls of said recess to retain said clip and nut on said stab until said terminal screw is inserted through said aperture in said top wall and said aperture in said flat stab to clamp said terminal end of said conductor for electrical connection to said flat stab.

12. The combination of claim 11 wherein said top wall of said spring clip has means extending axially downward around said central aperture to engage said aperture in said flat stab to secure said spring clip on said free end of said flat stab with said tapped hole in said nut in registration with said aperture and said stab.

13. The combination of claim 12 wherein said nut is generally rectangular with opposed sides and wherein said projections comprise ears extending laterally outward from said opposed sides to engage said slots in said side walls.

14. The combination of claim 13 wherein said slots in said side walls have a bottom edge 51 spaced from said top wall 9 by a distance d selected to accommodate flat stabs of a range of thicknesses t.

15. A spring clip for securing an electrical conductor to a flat stab in a recess in an electrical terminal housing having opposed side walls in said recess, said stab having an aperture spaced from its free end; said clip being made from a single piece of electrically conductive spring material and comprising a top wall having a central aperture therethrough, a pair of side edges to said top wall with a side wall projecting downward from each side edge, each said side wall having a slot in it and having a bottom edge with a flange on the bottom edge projecting outwardly from the side wall to an outer edge of the flange; said top wall and said side walls forming a yoke for receiving a flat nut having lateral projections for engagement in said slots in said side walls; said clip sliding onto said free end of said stab which is received in said yoke between said top wall and said nut with said outer edges of said flanges frictionally engaged against said side walls of said recess in said terminal housing.

16. A spring clip as set forth in claim 15 wherein said central aperture in said top wall has a downwardly extending axial projection on it for engaging said aperture in said stab to retain the clip on the stab.

17. A spring clip as set forth in claim 16 wherein said axial projection comprises an axially extending flange.

* * * * *